US006666200B2

(12) United States Patent
Davis, Jr. et al.

(10) Patent No.: US 6,666,200 B2
(45) Date of Patent: Dec. 23, 2003

(54) METHOD FOR CANISTER PURGE COMPENSATION USING INTERNAL MODEL CONTROL

(75) Inventors: Leighton Ira Davis, Jr., Ann Arbor, MI (US); Lee Albert Feldkamp, Plymouth, MI (US); Fumin Yuan, Canton, MI (US); Gerald Jesion, Woodhaven, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 99 days.

(21) Appl. No.: 10/010,211

(22) Filed: Dec. 10, 2001

(65) Prior Publication Data

US 2003/0106544 A1 Jun. 12, 2003

(51) Int. Cl.[7] ..... F02D 41/14; F02M 25/08
(52) U.S. Cl. ..... 123/698; 123/520
(58) Field of Search ..... 123/520, 674, 123/698; 701/103, 104, 109

(56) References Cited

U.S. PATENT DOCUMENTS

| | | | | |
|---|---|---|---|---|
| 5,048,493 A | | 9/1991 | Orzel et al. | 123/674 |
| 5,186,153 A | | 2/1993 | Steinbrenner et al. | 123/519 |
| 5,190,020 A | * | 3/1993 | Cho | 123/684 |
| 5,613,481 A | | 3/1997 | Kitagawa et al. | |
| 5,682,317 A | * | 10/1997 | Keeler et al. | 701/101 |
| 5,735,255 A | | 4/1998 | Farmer et al. | 123/698 |
| 6,039,032 A | | 3/2000 | Morikawa et al. | |
| 6,102,018 A | * | 8/2000 | Kerns et al. | 123/674 |
| 6,227,177 B1 | | 5/2001 | Yamafuji et al. | 123/520 |
| 6,405,122 B1 | * | 6/2002 | Yamaguchi | 701/109 X |
| 6,523,531 B1 | * | 2/2003 | Feldkamp et al. | 123/698 |

FOREIGN PATENT DOCUMENTS

| | | |
|---|---|---|
| GB | 2 326 740 A | 12/1998 |
| GB | 2 336 222 A | 10/1999 |

OTHER PUBLICATIONS

Isabelle Rivals et al.; Proceedings of the IEEE International Symposium on Industrial Electronics; "Internal Model Control Using Neural Networks", ISIE '96; Warsaw–Poland; Warsaw University of Technology; Jun. 17–20, 1996; vol. 1 of 2; pp. 109–114.

* cited by examiner

*Primary Examiner*—Tony M. Argenbright
(74) *Attorney, Agent, or Firm*—Daly, Crowley & Mofford, LLP; Julia Voutyras

(57) ABSTRACT

A method for air/fuel operation of an engine. The method includes providing a model of the engine. The model represents a relationship between: (1) a signal model LAMBSE, representative of estimated air/fuel ratio of the engine relative to a stoichiometric air/fuel ratio for the engine; and, (2) fuel injected into the cylinder of the engine. Exhaust gas oxygen emission from the engine is measured during operation of such engine. Actual LAMBSE produced by such engine during operation of such engine is produced as a function of such measured oxygen. The actual LAMBSE is compared with the model LAMBSE provided by the model in response to fuel injected into the engine to produce a model error signal. The fuel injected into the engine is adjusted in accordance with the error signal.

9 Claims, 11 Drawing Sheets

METHOD FOR CANISTER PURGE COMPENSATION USING INTERNAL MODEL CONTROL

TECHNICAL FIELD

This invention relates to generally to engine air/fuel ratio control systems, and more particularly to air/fuel ratio control systems wherein such engine recovers fuel vapors which are purged from the fuel system and are fed to the engine.

BACKGROUND AND SUMMARY

Engine air/fuel control systems are known in which fuel delivered to the engine is adjusted in response to the output of an exhaust gas oxygen sensor to maintain average air/fuel ratios at a stoichiometric value. Such systems may also include a fuel vapor recovery system wherein fuel vapors are purged from the fuel system into the engine's air/fuel intake. An example of such a system is disclosed in U.S. Pat. No. 5,048,493.

More particularly, current statutory regulations place a limit on the amount of fuel vapor that a passenger vehicle or light truck can emit while in operation or at rest. It is no longer acceptable merely to vent gasoline vapor to the atmosphere in order to relieve an accumulation of vapor due to high ambient temperature or heating of the fuel by proximity to sources of heat in the vehicle. The production of vapor can, in principle, be minimized by careful design, but cannot be entirely eliminated when certain conditions are present. Pressure build-up is reduced by storage of vapor on the surface of a material with high surface area, typically activated charcoal. In addition, to control the amount of vapor accumulated, modern automobiles carry out an operation called purge, in which vapor from the fuel tank and the storage canister is ingested into the engine, where it adds to fuel delivered by the usual fuel injection process. The purge process has the effect of adding both fuel and air to that supplied as part of the usual engine control strategy. In general, the delivered fuel and air are unmetered, because precise metering would entail both a flow meter and a sensor capable of measuring the fuel concentration in the purge flow. The addition of unmetered fuel and air complicates the control of the ratio of air to fuel (usually termed A/F), a quantity which must be closely regulated for minimum emissions. In extreme cases, excessive fuel from purge may cause the engine to stall. In the absence of a compensatory mechanism, the entire burden of handling the effects of purge is left to the usual closed-loop air/fuel (A/F) control strategy. In general terms, an excess of fuel due to purge will be handled by a reduction of injected liquid fuel; conversely, an excess of air (e.g., caused by a purge with minimal concentration of fuel) will be handled by an increase in the injected fuel. In neither case is the tendency of the added air flow to increase engine speed countered, nor is the effect of this flow on other parts of the strategy that depend on the knowledge of the mass flow of air taken into account. A further complication arises from the fact that some control strategies make diagnostic use of the value or pattern of values of the prime control variable in the A/F strategy. When the effect of purge is handled by the closed-loop control strategy, this control variable may spend considerable time at otherwise unusual values, thereby complicating diagnostic inferences.

To mitigate any deleterious effects of purge as just described, it is common to employ a purge compensation strategy. Compensation for purge fuel is frequently implemented by subtracting a term from the calculation of fuel for each cylinder event. This term is intended to be an estimate of the fuel per event provided by the purge flow. The underlying principle is the following: if this term is correct, then the average value of the internal estimate of the A/F control variable will be equal to its nominal value. In typical control strategies the A/F control variable is called LAMBSE, and its nominal value is unity. More particularly, LAMBSE is at an average value of unity when engine is operating at stoichiometry and there are no steady-state air/fuel errors or offsets. For a typical example of operation, LAMBSE ranges from 0.75–1.25. In typical closed-loop control, the value of LAMBSE is driven in an oscillatory fashion on the basis of an exhaust gas oxygen (EGO) sensor. Hence, the value of the purge term in the fuel calculation is adjusted in a direction such that the mean value of LAMBSE tends toward unity. This is usually performed essentially as a simple integral controller, in which the difference between LAMBSE and unity is integrated (accumulated), multiplied by a chosen constant parameter, converted to units of fuel injected per event, and inserted (subtractively) into the fuel calculation. In this method of computing fuel compensation, the control variable LAMBSE is effectively treated as the output of a system for which the compensation value is the control input.

The inventors herein have discovered numerous problems with prior air/fuel-purge compensation control systems. More particularly, the inventors have recognized that with the above described method of computing fuel compensation, the control variable LAMBSE is effectively treated as the output of a system for which the compensation value is the control input. Considered from this viewpoint, the system contains a delay between the time of application of the control input and the time of consequence of this input as observed at the system output. As is usual when such a system is treated with simple integral control, the integral control coefficient must be chosen to be small enough to avoid instability. Such instability could manifest itself, for example, as oscillations of system input and output. The practical consequence is that the extra fuel that is present upon initiation of the purge operation is compensated only after a significant time has elapsed. The disruptive effect of this lag in compensation may be partially mitigated by opening the purge valve slowly rather than rapidly. Unfortunately, if this is done, the time required to purge the fuel stored in the canister increases. In some cases this may pose a difficulty, since other required aspects of engine control and diagnostics are best performed when purge is not in operation. Another disadvantage of the simple integral compensation method is that a correct estimate of the fuel content of the purge stream occurs, at best, only in steady state when the error in the mean value of LAMBSE has been reduced to zero. This is a direct consequence of not treating delays explicitly.

In accordance with the present invention, a method is provided for controlling an air/fuel ratio of an engine, such engine being supplied fuel from a fuel injection system to inject fuel into a cylinder of such engine. The method includes providing a model of the engine. The model represents a relationship between: (1) a signal model LAMBSE, representative of estimated air/fuel ratio of the engine relative to a stoichiometric air/fuel ratio for the engine; and, (2) fuel injected into the cylinder of the engine. Exhaust gas oxygen emission from the engine is measured during operation of such engine. Actual LAMBSE produced by such engine during operation of such engine is produced as a function of such measured oxygen. The actual LAMBSE is compared with the model LAMBSE provided by the model in response to fuel injected into the engine to produce a model error signal. The fuel injected into the engine is adjusted in accordance with the error signal.

In one embodiment, the adjusting includes providing a reference LAMBSE signal. A model inverse to the first-mentioned model is also provided. The error signal is compared with the reference LAMBSE signal to produce a second error signal. The second error signal is fed to the inverse model to generate the fuel signal for the engine. The fuel signal is fed to the first-mentioned model to provide the model LAMBSE signal.

In one embodiment, the first-mentioned model includes a first section representative of a delay-free model of the engine and a second section. The second section represents a delay in the engine between a time a change in the fuel is injected into the engine and a time a change in the oxygen in the exhaust emission from such change in fuel is sensed. The method combines the delay free model output signal with the second error signal to produce the signal fed to the inverse model.

In one embodiment, the method combines an output of the second section with the actual LAMBSE to produce the first-mentioned error signal.

In one embodiment the first-mentioned model is a linear model.

In one embodiment the delay free section is represented as: $y_m=1+G_m u$, where $G_m$ is the gain of the model, u is the input to the model and $y_m$ is the output of the model.

In one embodiment, reference LAMBSE signal includes a feedforward air/fuel ratio control signal in accordance with anticipated fuel through the purging system.

In one embodiment the producing the feedforward air/fuel ratio control signal comprises determining fuel flow rate through the purge system.

In one embodiment the purge system includes a valve, such valve passing the fuel in the purging system to the intake manifold at a rate related to a duty cycle of a control signal fed to such valve. The flow rate through the purge system is determined in response to the duty cycle the control signal fed to the valve.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
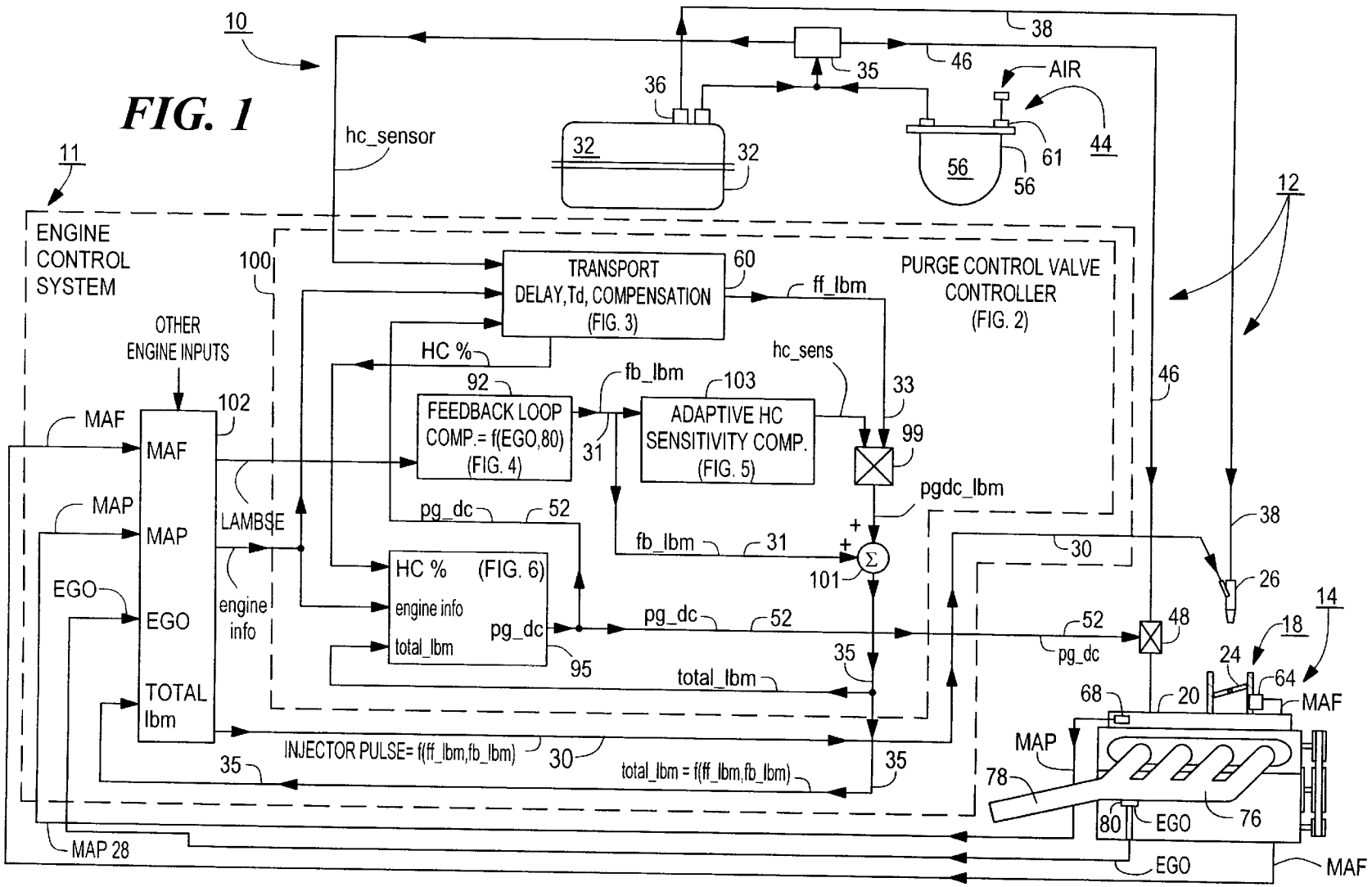
FIG. 1 is a block diagram an engine and air/fuel ratio control system therefor according to the invention.

Referring first to FIG. 1, an engine system 10 is shown to include an engine control system 11, a fuel system 12, and an engine 14.

The engine 14 has a throttle body 18 coupled to intake manifold 20. Throttle body 18 is shown having throttle plate 24 positioned therein for controlling the introduction of ambient air into intake manifold 20. Fuel injector 26 injects a predetermined amount of fuel into throttle body 18 via fuel rail 38 in response to fuel injector control signal (INJECTOR PULSE) on line 30 by the engine control system 11, in a manner to be described. The engine 14 is also supplied fuel from a fuel purging system 44 to purge fuel in a fuel supply 32 and feed such purged fuel to an intake manifold 20 of the engine 14 through a purge control valve 48. The purge control valve 48 is controlled by a control signal pg_dc produced on line 52 by the engine control system 11, in a manner to be described. Thus, the engine 14 is supplied fuel from both the fuel purging system 44 and a fuel injection system having the fuel injector 26.

Engine 14 also includes exhaust manifold 76 coupled to here a conventional 3-way ($NO_x$, CO, HC) catalytic converter 78. Exhaust gas oxygen (EGO) sensor 80, a conventional two-state oxygen sensor in this example, is shown coupled to exhaust manifold 76 for providing an indication of air/fuel ratio operation of engine 14. More specifically, exhaust gas oxygen sensor 80 provides a signal having a high state when air/fuel ratio operation is on the rich side of a predetermined air/fuel ratio commonly referred to as stoichiometry (14.7 lbs. air/lb. fuel in this particular example). When engine air/fuel ratio operation is lean of stoichiometry, exhaust gas oxygen sensor 80 provides its output signal at a low state.

Figure 2:
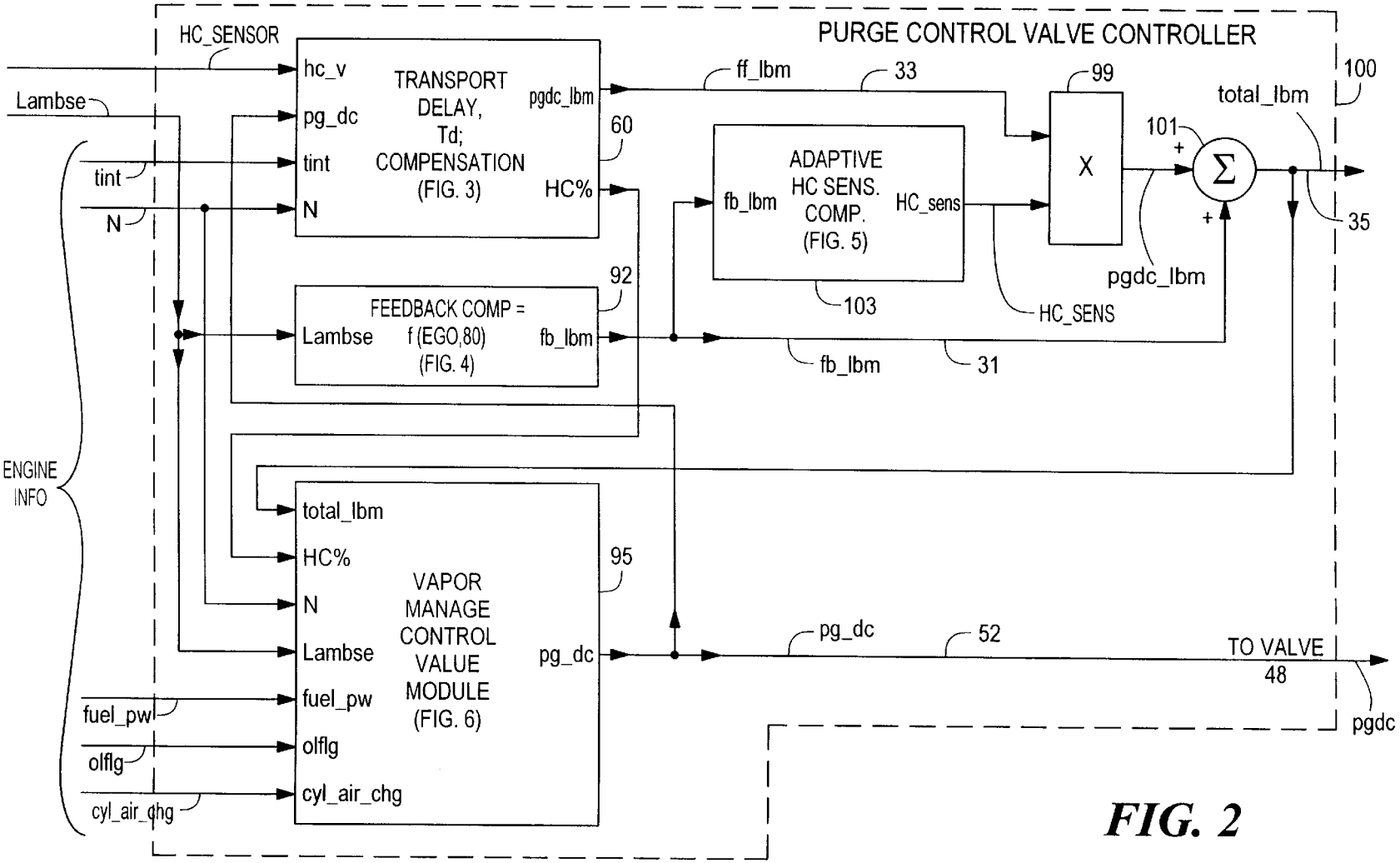
FIG. 2 is a block diagram of a purge control valve system used in the air/fuel ratio control system of FIG. 1.

As described in greater detail later herein, the engine control system 11 includes a standard air/fuel ratio controller 102 and a purge control valve controller 100, to be described in more detail in connection with FIG. 2. The fuel injector control signal produced on line 30 by the standard air/fuel ratio controller 102 is a function of both: (1) a first air/fuel ratio, here feedback, signal, fb_lbm, is produced on line 31 within the purge control valve controller 100 in accordance with measured exhaust gas oxygen emission from the engine 14 and sensed by an EGO sensor 80; and, (2) a second air/fuel ratio, feedforward, control signal, ff_lbm, produced on line 33 within the purge control valve controller 100 in accordance with fuel concentration and transport delay, $\tau_d$, through the fuel purging system 44. As will be described in more detail below, the feedforward signal ff_lbm produced on line 33 is in turn a function of: the amount of vapor sensed by a hydrocarbon sensor 35; the control signal to the valve 48 on line 52; and, a model of the transport delay, $\tau_d$, between the time the hydrocarbon sensor 35 detects a certain concentration of fuel being purged and the time such certain concentration of purged fuel is used by the engine 14. Suffice it to say here that the first and second air/fuel ratio control signals, fb_lbm and ff_lbm, are combined within the purge control valve controller 100 into a composite fuel injector pulse control signal, total_lbm, on line 35. The composite purge fuel control signal on line 35 (having two components, i.e., the feedback portion, fb_lbm, and the feedforward portion, ff_lbm) is processed by the standard air/fuel ratio controller 102 in a conventional manner to produce the pulse for the fuel injector 26 on the (INJECTOR PULSE) line 30. Thus, the fuel injector pulse on line 30 is a function of both the feedback signal, fb_lbm and the transport delay, $\tau_d$, compensating feedforward signal, ff_lbm.

More particularly, fuel is delivered to fuel injector 26 by a conventional fuel system including fuel tank 32, fuel pump 36, and fuel rail 38. The fuel vapor recovery system 44 is shown coupled between fuel tank 32 and intake manifold 20 via purge line 46 and purge control valve 48. In this particular example, fuel vapor recovery system 44 includes vapor purge line 46 which is connected between fuel tank 32 and canister 56 which absorbs fuel vapors therefrom by activated charcoal contained within the canister. As noted briefly above, the purge control valve 48 is controlled by the signal, pg_dc, on line 52. As will be described in more detail below, the control signal on line 52 is a function of the amount of vapor sensed by a hydrocarbon sensor 35 and the composite signal total_lbm produced by the purge control valve controller on line 35.

As noted briefly above, and as will be described in more detail below, the feedforward signal ff_lbm produced on line 33 is a function of: the amount of vapor sensed by a hydrocarbon sensor 35; the control signal to the valve 48 on line 52; and, a model of the transport delay, $\tau_d$, between the time the hydrocarbon sensor 35 detects a certain concentration of fuel being purged and the time such certain concentration of purged fuel is used by the engine 14. The transport delay, $\tau_d$, is determined as a result of a test to be described in connection with FIG. 11. The model of such transport delay, $\tau_d$, is stored in the purge control valve controller 100. The transport delay, $\tau_d$, which not a constant but a function of flow, is determined a priori as a result of test performed on the engine system in a manner to be described below in connection with FIG. 11. It should be noted that, in this particular example, valve 48 is a pulse width actuated solenoid valve. The flow though the valve 48 is a function of the duty cycle of the signal pg_dc signal produced on line 52 operating such valve 48.

Referring now in more detail to the purge control valve controller 100, such controller 100 is shown to include:

- a transport delay, $\tau_d$, compensation module 60, to be described in more detail in connection with FIG. 3;
- a feedback loop compensation module 92, to be described in more detail in connection with FIG. 4 and which produces the feedback signal, fb_lbm, on line 31 as a function of the amount of oxygen in the exhaust gases sensed by EGO sensor 80;
- an adaptive hydrocarbon (HC) sensitivity compensation module 103, to be described in more detail in connection with FIG. 5; and
- a vapor management control valve module 95, to be described in more detail in connection with FIG. 6.

During fuel vapor purge, air is drawn through canister 56 via inlet vent 61 and adsorbs hydrocarbons from the activated charcoal. The mixture of purged air and absorbed vapors is then inducted into intake manifold 20 via purge control valve 48. The control signal pg_dc on line 52 is a function of the amount of vapor sensed by the sensor 35 and the composite signal total_lbm on line 35. The pg_dc signal on line 52 for the valve 48 and the total_lbm signal on line 35 are generated by a purge control valve controller 100 (shown in more detail in FIG. 2) and a standard air/fuel ratio strategy controller 102.

Conventional sensors are shown coupled to engine 14 for providing indications of engine operation. In this example, these sensors include mass airflow sensor 64 which provides a measurement of mass airflow (MAF) inducted into engine 14. Manifold pressure sensor 68 provides a measurement (MAP) of absolute manifold pressure in intake manifold 20. A temperature sensor, not shown, provides a measurement of engine operating temperature (T). Throttle angle sensor, not shown, provides throttle position signal TA. Engine speed sensor, not shown, provides a measurement of engine speed (rpm) and crank angle (CA).

The output of the exhaust gas oxygen (EGO) sensor 80 is fed, via line 28, to the controller 102. Also fed to the controller 102 are MAP, MAF, and other engine inputs along with the total_lbm signal on line 35. The standard air/fuel ratio strategy controller 102 generates from these and other engine sensed operating parameters, the following engine information in any conventional manner,

- tint=the time, in seconds, since the last time the calculation was made;
- N=engine speed, in revolutions per minute;
- fuel_pw=fuel pulse width, arbitrary units;
- olflg=open loop flag, i.e., indication that the conventional A/F controller is not using the EGO signal for feedback control;
- cyl_air_charge=air charge, in pounds per minute, for each cylinder combustion event;
- along with LAMBSE for the purge control valve controller 100 and the INJECTOR PULSE on line 30 for the fuel injector 26.

Thus, as will be described in more detail below, the purge control valve controller 100 is used to compensate for transport delay, $\tau_d$, described above. Such controller 100, includes four sections:

1) The transport delay, $\tau_d$, compensation module 60 (FIG. 3) which produces the feedforward signal ff_lbm as a function of hydrocarbons sensed by sensor 35 (i.e., HC_sensor), the purge duty cycle signal pg_dc produced by the vapor management control valve module 95 on line 52; and engine information.
2) The feedback compensation module 92 (FIG. 4) for produces the feedback signal, fb_lbm. The signal fb_lbm is combined with the feedforward signal ff_lbm in algebraic summer 101, to produce the composite control signal, total_lbm, on line 35. As noted above, the control signal on line 30 for the fuel injector 26 is a function of the composite control signal, total_lbm. As also noted above, the signal fb_lbm on line 31 is the portion of the fuel injector signal on line 30 which would result in the fuel injector 26 injecting an amount of fuel in accordance with LAMBSE alone while ff_lbm is the portion of the signal on line 30 is used to anticipate, and hence compensate for, the transport delay, $\tau_d$ in the purge vapor in the purge system.

3) The adaptive hydrocarbon sensor sensitivity module 103 (FIG. 5) which determines the sensitivity of the HC sensor 35, such sensitivity being a function of LAMBSE error from stoichiometry; and 4) The vapor management control valve module 95 (FIG. 6) which produces the purge duty cycle pg_dc for the control signal on line 52 for valve 48.

The combination of these control elements of the purge control valve controller 100 provides the desirable steady-state behavior of integral control with the ability to respond quickly and appropriately to purge disturbances. In the present application, the primary time delay is fuel vapor transport delay, $\tau_d$, which varies according to purge vapor line length and flow rate. Flow rate is not measured explicitly, but is estimated to be proportional to the purge duty cycle pg_dc of the signal fed to the valve 48 via line 52 after taking into account the threshold for opening the valve 48. The feed forward control signal ff_lbm, is thus based on an estimate of the fuel content of the purge stream provided by the hydrocarbon sensor 35 and a model of the time delay, $\tau_d$, for that concentration to reach the intake manifold 20 through the purge vapor line (passing from the sensor 35 through line 46 and being used by the engine 14, i.e., its effect being detected later by the EGO sensor 80). The hydrocarbon sensor 35 here uses a speed-of-sound measurement that is proportional to hydrocarbon concentration, assuming a certain speciation of hydrocarbons. The uncertainty in speciation, as well as uncertainty in the proportional factor relating valve 48 duty cycle to flow rate, are both taken into account by adapting a multiplicative factor HC_sens produced by the hydrocarbon sensor sensitivity unit 103 according to LAMBSE error (i.e., deviation of average exhaust gas oxygen from stoichiometry).

Figure 3:
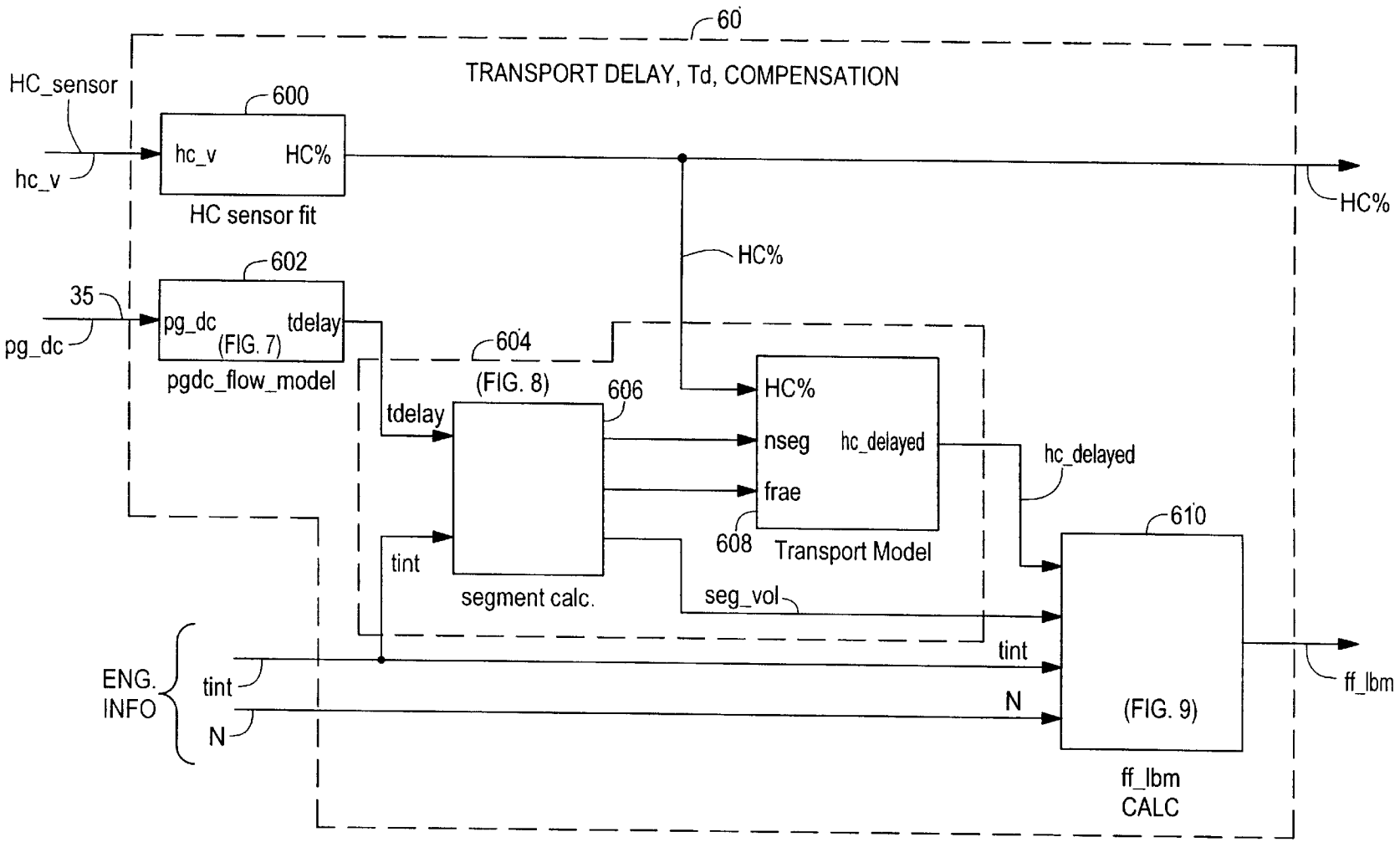
FIG. 3 is a block diagram of a transport delay, $\tau_d$, compensation module used in the air/fuel ratio control system of FIG. 1.
Figure 4:
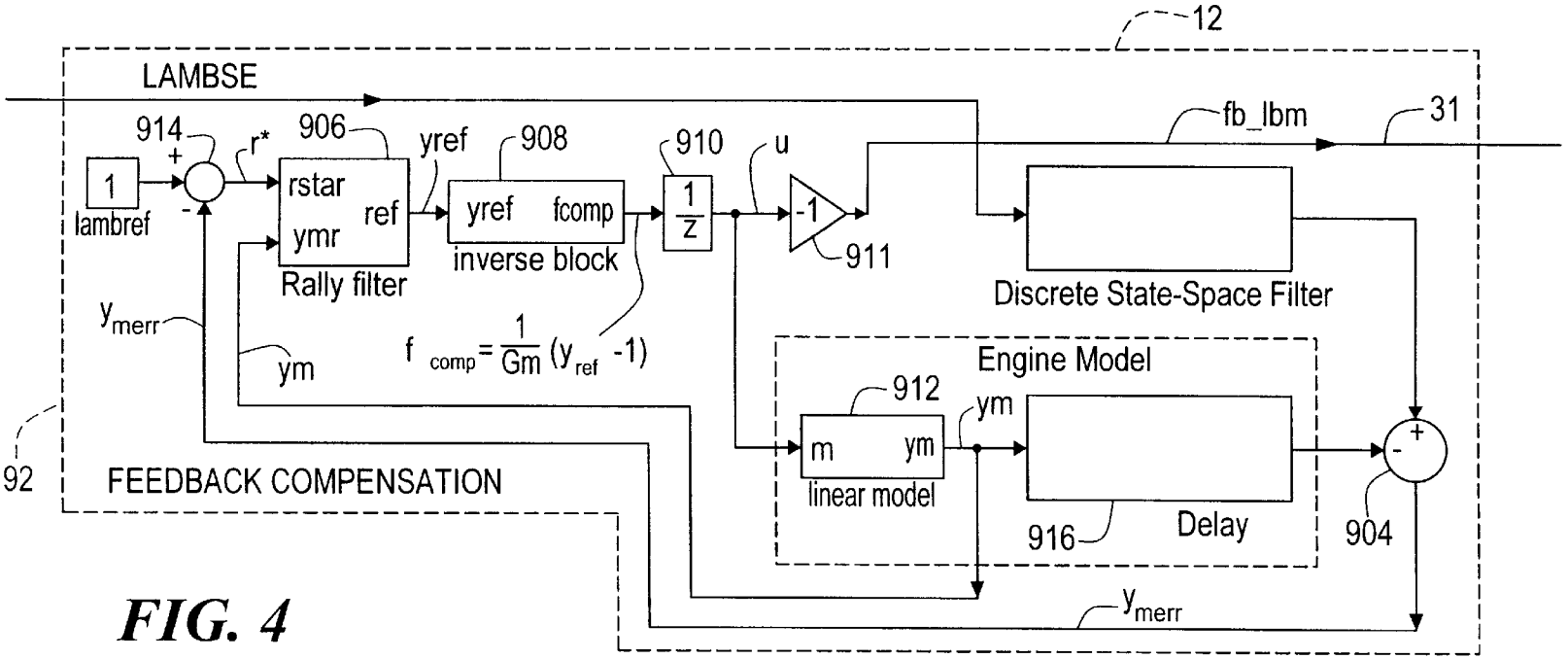
FIG. 4 is a block diagram of a feedback compensation nodule used in the air/fuel ratio control system of FIG. 1.

Referring now in more detail to the various modules of the purge control valve controller 100, reference is first made to the transport delay, $\tau_d$, compensation module 60 shown in more detail in FIG. 3. The module 60 includes: an HC sensor fit module 600, a pgdc_flow module 602 (shown in more detail in FIG. 7), a module 604 (shown in more detail in FIG. 8) having a segment calculation module 606 and a transport module 608; and, a ff_lbm calculation module 610 (shown in more detail in FIG. 9).

Figure 10:
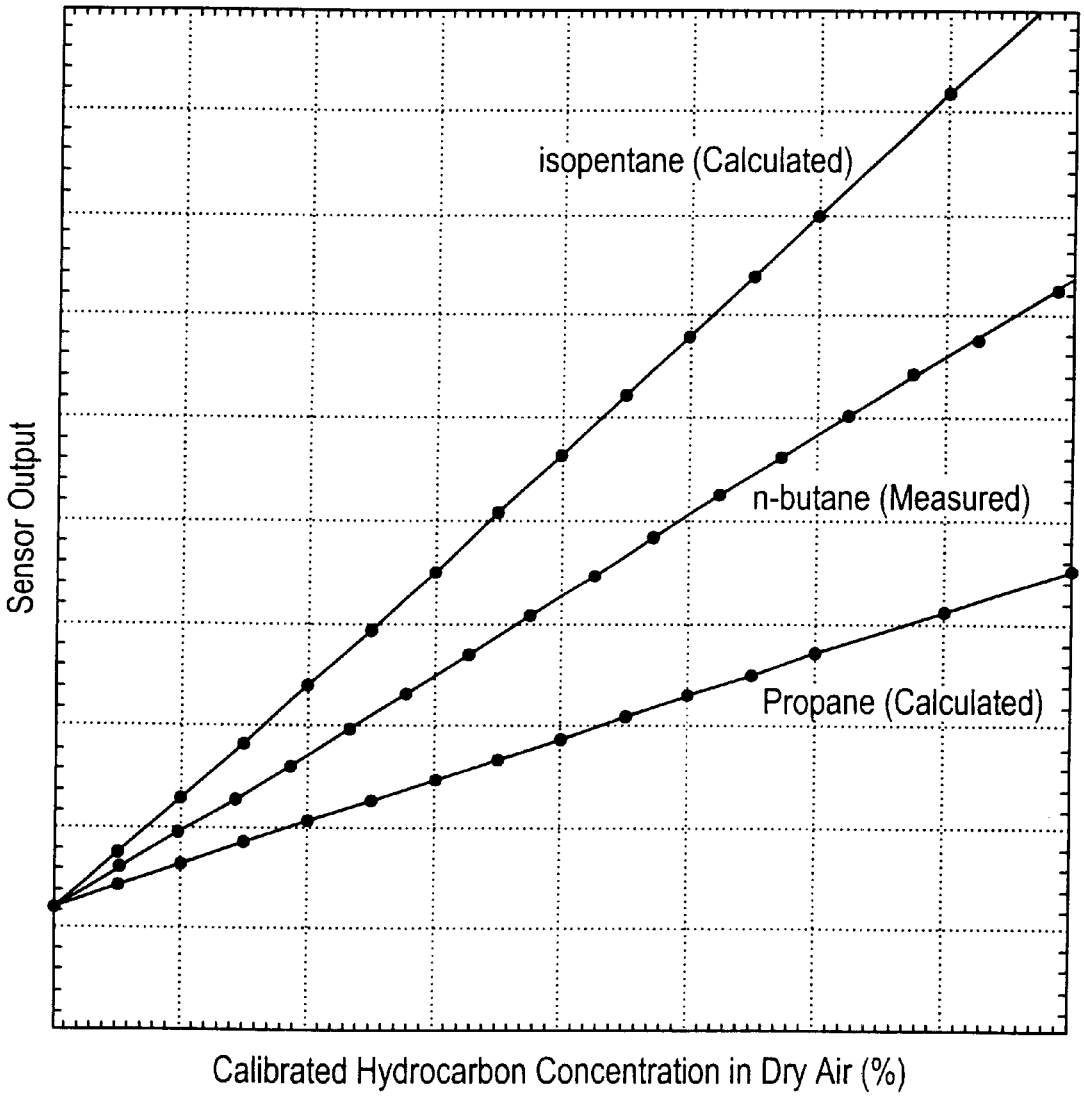
FIG. 10 are curves showing the relation of the output of a hydrocarbon sensor used in the system of FIG. 1 as a function of hydrocarbon concentration for various hydrocarbon species.

Before discussing the HC sensor module it should be noted that the hydrocarbon sensor 35 is here of the type described in "Automotive Gasoline Vapor Sensor", J. H. Visser, D. J. Thompson, D. H. Schonberg, W. Lewis, Jr., P. Moilanen, W. O. Siegel, and E. M. Logothetis, Technical Digest of the 7th International Meeting on Chemical Sensors, pp. 446–448, 1998. It is installed in the line 46 (FIG. 1) just after the junction between the canister 56 and fuel tank 32, (sufficiently before the valve 48 to give an adequate delay) and provides a reading proportional to the concentration of hydrocarbon gases in the flow at that point. Its response time is a fraction of a second and is able to be calibrated to any particular species of hydrocarbon. The proportionality does change from one hydrocarbon species to another, sometimes more than a factor of two (2.7 from propane to isopentane, for example, as shown in FIG. 10), and since there is opportunity for different species to 'distill' from the gas tank, the speciation of purge vapors may change with time. The heating value for different hydrocarbon species changes as well, which also affects the appropriate air-fuel ratio. In consequence, it is appropriate to use a multiplicative factor, HC_sens, in modeling the hydrocarbon sensitivity module 103 (FIG, 1) that is slowly adapted according to LAMBSE deviation from unity.

It is also noted that the signal on line 28 is related to LAMBSE. More particularly, by processing the signal on line 28 with proportional plus integral action in this particular example, such processed signal becomes LAMBSE (i.e., an average value of unity when engine 14 is operating at stoichiometry and there are no steady-state air/fuel errors or offsets). For a typical example of operation, LAMBSE ranges from 0.75–1.25. The signal LAMBSE is fed to a feedback loop compensation module 92 (FIG. 4) which produces the feedback control signal fb_lbm in a manner to be described in connection with FIG. 4. Suffice to again mention that the signal fb_lbm is a purge disturbance compensation feedback signal which is a function of the EGO sensor 80 output and would be used to compensate the fuel injected into the engine via the fuel injector 26 in systems without the feedforward signal ff_lbm.

Now referring again to the HC sensor fit module 600, such module 600 stores a calibration, here a polynomial fit or mathematical curve obtained by testing the hydrocarbon sensor 35 (FIG. 1). The stored curve provides a transfer function between the voltage produced at the output of the sensor 35 (HC_sensor) and the percentage of hydrocarbons in the vapor sensed by the sensor 35 (HC %).

It is next noted that it is important to include the transport delay from sensor 35 to intake manifold 20 in order to correctly model the feed forward response and compensate for transients. In theory, the delay should be equal to the volume of the purge line divided by the flow rate. In practice, data relating LAMBSE transients to step transitions at various flow rates is fit using a simple rational function in flow rate (pgdc_flow), to give the expected delay (tdelay). The flow rate is a function of the valve 48 duty cycle (pg_dc), usually modeled as linear with a threshold offset and obtained by fitting LAMBSE offset data to purge duty cycle.

Figure 7:
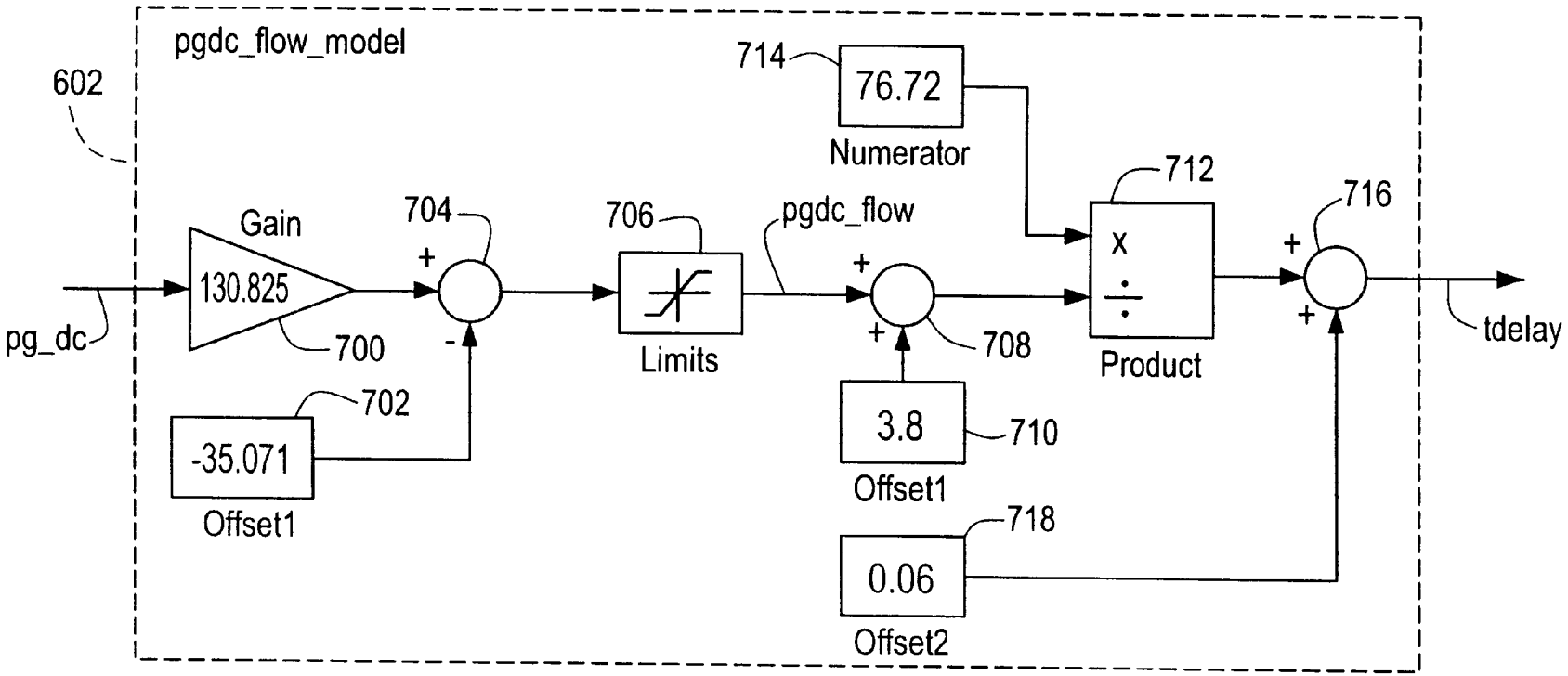
FIG. 7 is a block diagram of a purge duty cycle (pg_dc) flow model module used in the transport delay, $\tau_d$, compensation module of FIG. 3.

Referring now to FIG. 7, the pgdc_flow module 602 takes the signal pg_dc produced on line 52 and produces the output expected tdelay using the arrangement of gain 700, offset 702, summer 704, limiter 706 to produce an intermediate signal pgdc_flow, representing the flow of vapor through purge vapor control valve 48. The signal pgdc_flow is then used to produce tdelay via a rational function fit to test data. Pgdc_flow is fed to a summer 708 along with an offset 710. The output of summer 708 is fed to unit 712 that divides a numerator value 714 by the output of the summer 708. The result is fed to a summer 716 along with an offset 718 to produce the time delay tdelay. It should first be noted that the gains, offsets and limits are determined by characterizing a particular valve to be used with the engine.

Figure 8:
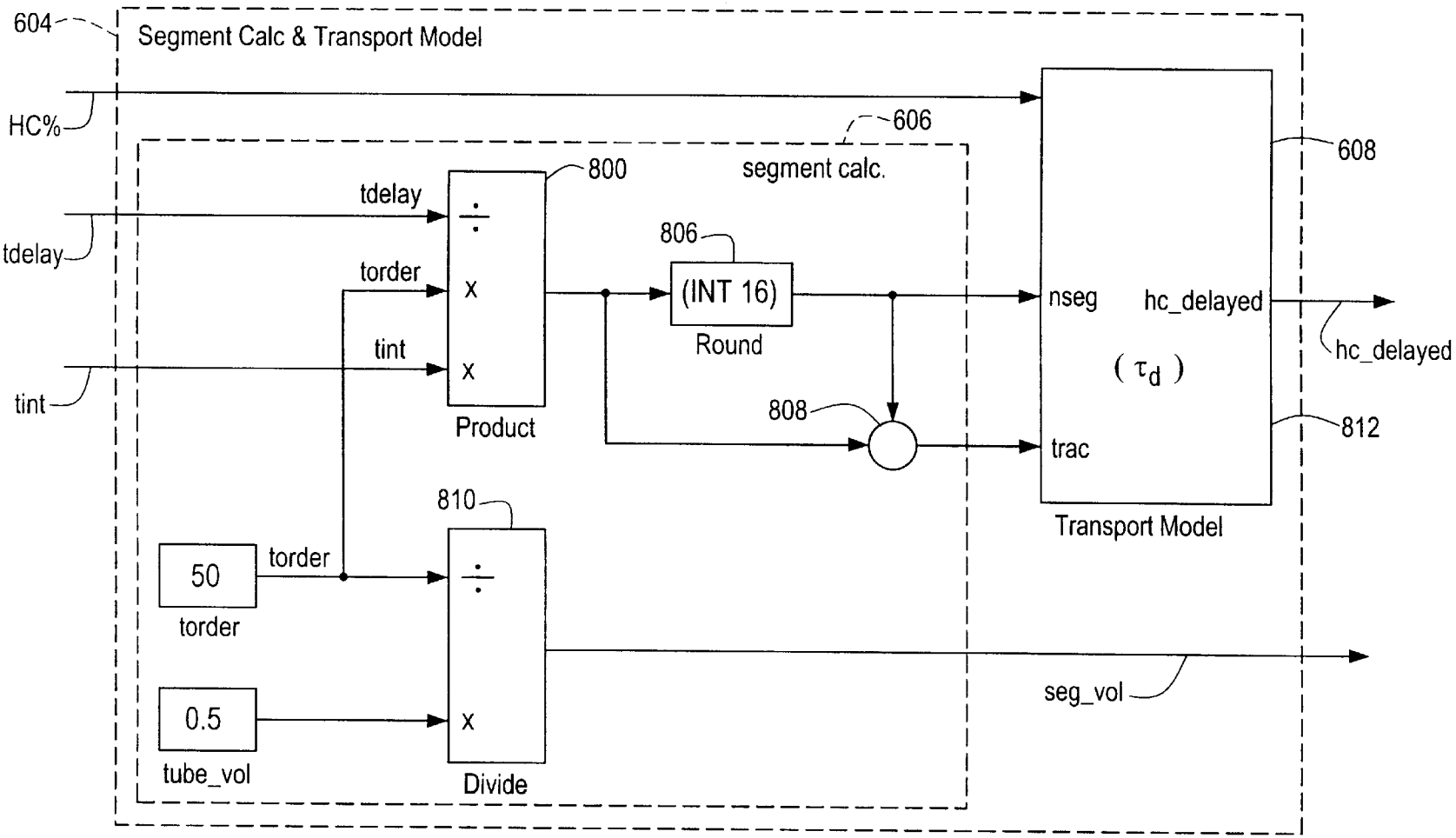
FIG. 8 is a block diagram of a segment calculation and transport model module used in the transport delay, $\tau_d$, compensation module of FIG. 3.

The signals tdelay and tint are fed to module 604, shown in more detail in FIG. 8 to include a segment calculation module 606 and a transport delay module 608. Modeling of the transport delay, $\tau_d$, is here done in a subroutine, peristal2( ), described below and here represented by module 608 (FIG. 8). The subroutine uses an Nth-order tapped delay line computational structure, each delay representing in effect a segment of the purge line 46 (FIG. 1). Module 606 (FIG. 8) translates tdelay in seconds into the equivalent number of modeled segments of line 46, as follows: The time between application of compensation controls (background loop time (tint)) is determined and divided by tdelay, see module 800. This ratio multiplied by the ratio between total line volume and divided by segment volume gives the number of modeled segments, nseg, see module 806, (of the modeled purge line) to have delivered their hydrocarbon to the intake manifold. A number, (frac), handles interpolation of the fraction of the last segment delivered. Module 810 divides the total volume of purge line 46 (constant 804) by the total number of segments modeled (constant 802) and passes this value for the segment volume on to further calculations (module 900). The total hydrocarbon mass delivered in this delay model HC_delayed (produced by module 812 (FIGS. 3 and 9) is fed to the ff_lbm calc. module 610 (shown in more detail in FIG. 9) and is subsequently converted to purge compensation variables to be used in the standard PCOMP routine shown in FIG. 9.

Figure 9:
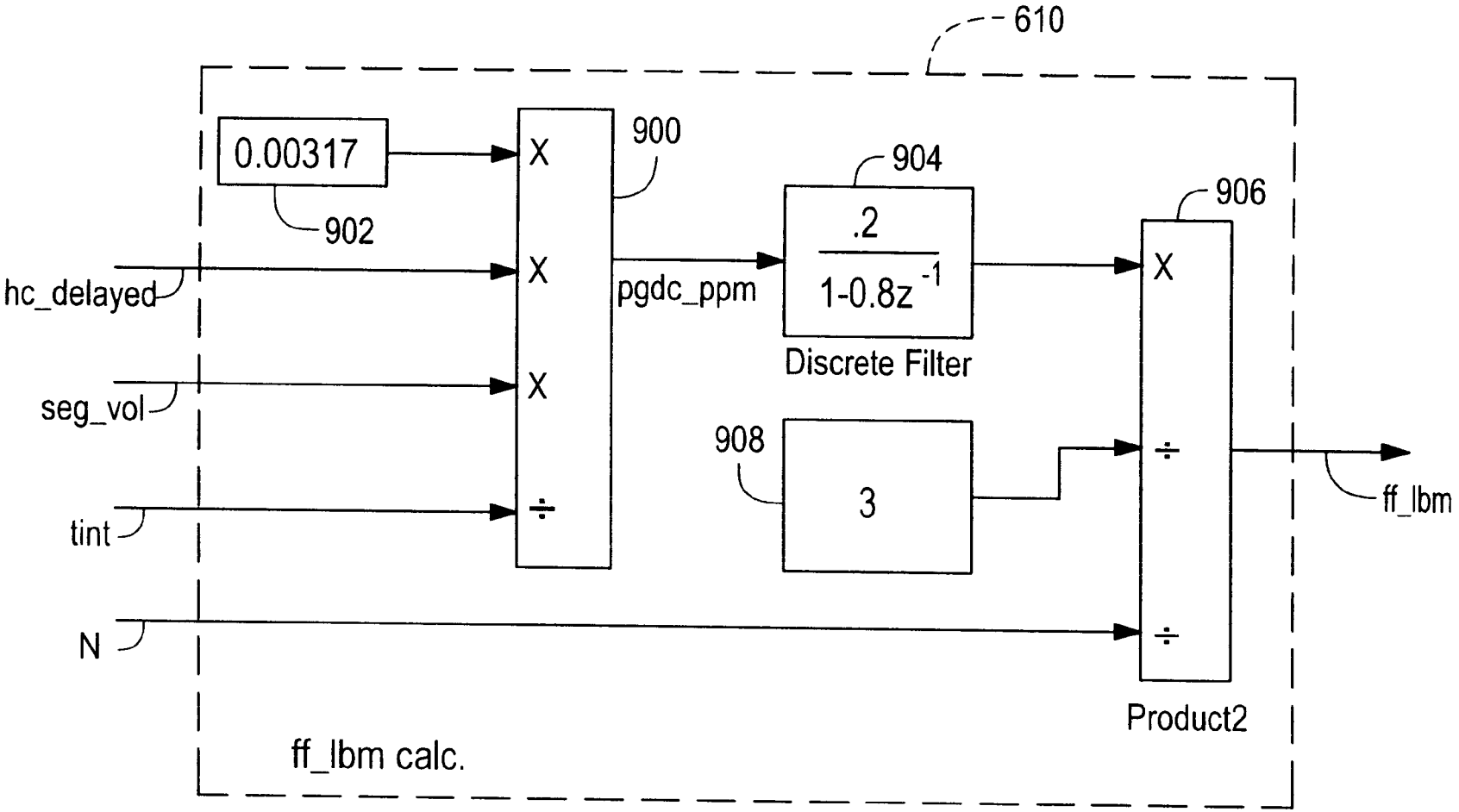
FIG. 9 is a block diagram of a feedforward signal, ff_lbm, calculation module used in the transport delay, $\tau_d$, compensation module of FIG. 3

Thus, referring to FIG. 9, module 610 includes a constant 902 feeding calculator 900 along with hc_delayed (from module 604, FIG. 8), seg_vol from a divider 810 fed by constants 803 and 804 in module 604, FIG, 8), and engine information, tint, to produce pgdc_ppm. This is fed to a discrete filter 904 to smooth the effects of using a finite model in 608. The output of the filter 904 along with engine rpm and a constant 908 are fed to a calculator 906 to produce the feedforward signal ff_lbm. This module thus converts a hydrocarbon concentration in the modeled portion of purge line 46 into first fuel mass flow, in pounds per minute (ppm), and then into fuel mass per injection, in pounds per event (lbm). Referring now to the feedback compensation module 92, FIG. 4, such module provides an internal model control (IMC) arrangement. The IMC arrangement allows engine time delay to be handled explicitly. In the present application, the engine time delay varies, with both random and systematic components of variation. Hence, it is advantageous that the IMC scheme is not overly dependent on precise knowledge of such delays.

It is first noted that a model of the engine, i.e., the relationship between fuel injected into the engine and average LAMBSE produced by the engine in response to such fuel is modeled by a linear model module 912 and transport delay module 916. The module 92 passes the measured LAMBSE provided by the controller 102 (FIG. 1) to a discrete state space filter 900 which is a low pass or lag filter to in effect provide an average value of LAMBSE. The output of this filter is indicated as $y_p$. This output $y_p$ is compared with the engine modeled $Y_{md}$ in a difference unit 904 to produce a model error $y_{merr}=y_p-y_{md}$, where $y_{md}$= Delay($y_m$, D), where $y_m$, the undelayed model output=1+ $G_m u$ and where D is the engine time delay referred to above (i.e., module 916). The difference, called $y_{merr}$, is subtracted from a reference LAMBSE, lambref, here 1.0, in subtractor unit 914 and the difference is processed by Rallying model 906 described in the Proceedings of the IEEE International Symposium on Industrial Electronics, Vol. pp. 109–114, June 1996 by J. Rivals and L. Personnaz, the entire subject matter thereof being incorporated herein by reference.

More particularly, the model error signal $y_{merr}$ is subtracted from lambref to in a subtractor unit 914. The difference is fed as the rstar (r*) input of the Rallying model 906. That is, r*=lambref−$y_{merr}$. Also, the output, $y_m$ of the linear portion of a linear model 912 is fed to the $y_{mr}$ input of the Rallying model 906. The output of the Rallying model 906, $y_{ref}=\alpha r^*+\beta y_m$, where α and β are constants, and where α+β=1, is fed to an inverse of the linear model 612, here the inverse block 908, where:

the relationship between the output $f_{comp}$ of the inverse model 908 and the input $y_{ref}$ to the inverse model is given by:

$$f_{comp} = \frac{1}{Gm}(y_{ref} - 1),$$

and the relationship between the output $y_m$ of the linear model 912 and the input u of the linear model is given by:

$$y_m=1+G_m u,$$

the relation where $G_m$ is the gain of the model 912 where u is fcomp after a one sample delay provided by delay 910. It is noted that u is fed to an inverter 911 to produce fb_lbm on line 31. As noted above, the output from delay 910, u, is also fed to the linear model 912, the output of which is also fed to a delay 916 prior to being fed to the differencing network 904, as shown. Modules 912 and 916 thus constitute a simple model of the fuel-to-LAMBSE process of the engine. The output of this model, $y_{pd}$ is compared to the actual average value of LAMBSE from the engine, $y_p$, and the difference, $Y_{merr}$, is fed back into the inverse module 908 in what amounts to an integral controller.

Figure 5:
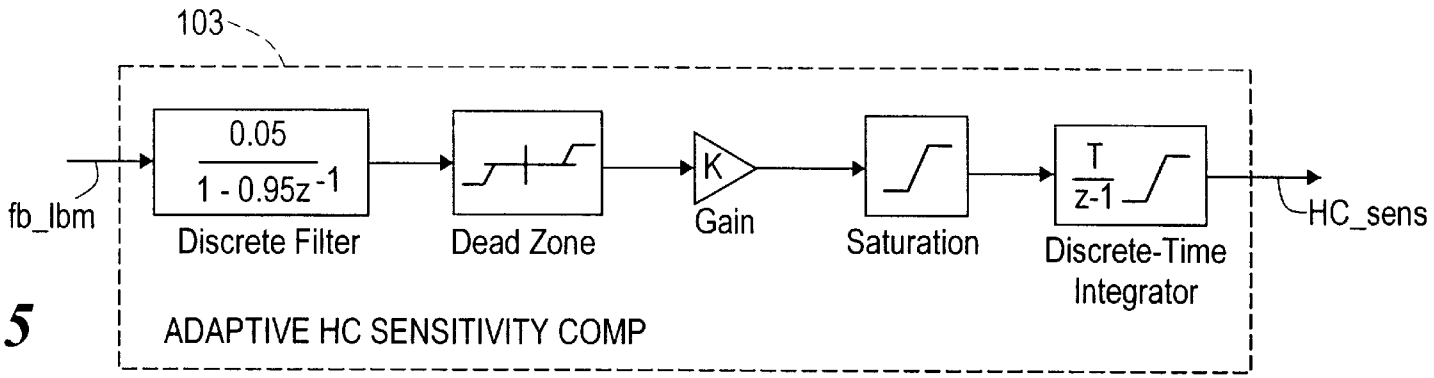
FIG. 5 is a block diagram of an adaptive hydrocarbon (HC) sensitivity compensation module used in the air/fuel ratio control system of FIG. 1.

Referring now to FIG. 5, the adaptive HC sensitivity module 103 is shown. Such module 103 includes a discrete filter, dead zone, gain, saturation, and discrete time integrator, arranged, as shown, to produce the HC_sens signal for the multiplier 99 (FIG. 1). This module constitutes an integral controller, based on the control error as represented by fb_lbm. It assumes that the error is due either to incorrect sensitivity of the HC sensor or error in the pg_dc to purge flow calibration. It adjusts (via integrating the error) a value, HC_sens, which multiples the feedforward portion of the control. Suitable non-linearities in the form of a deadzone in error and a value limitation are imposed for stability.

Figure 6:
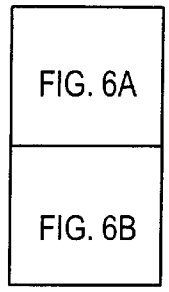
FIGS. 6, 6A and 6B are a flow diagram of the process performed by a vapor management control valve module used in the air/fuel ratio control system of FIG. 1.
Figure 6A:
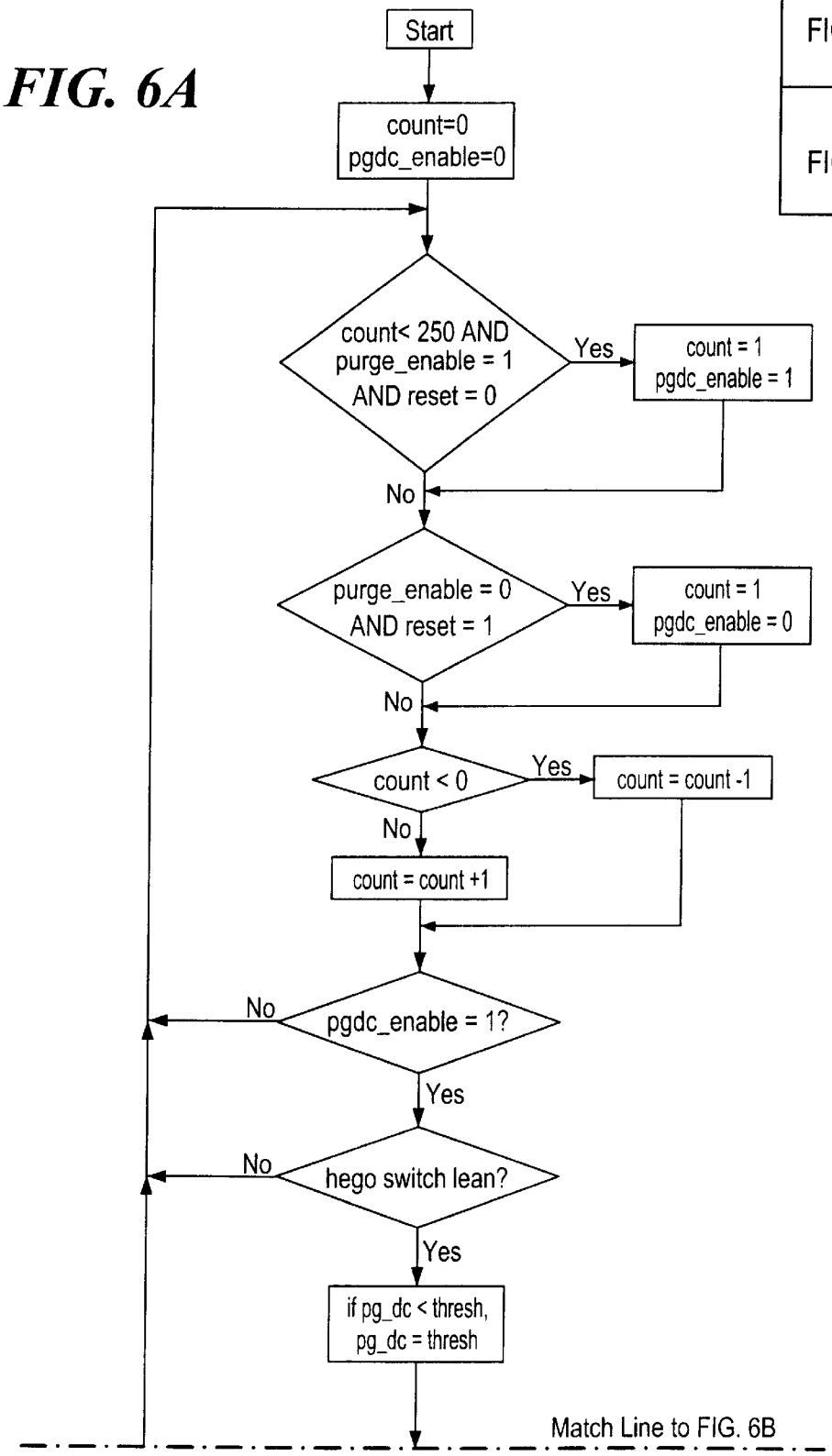
Figure 6B:
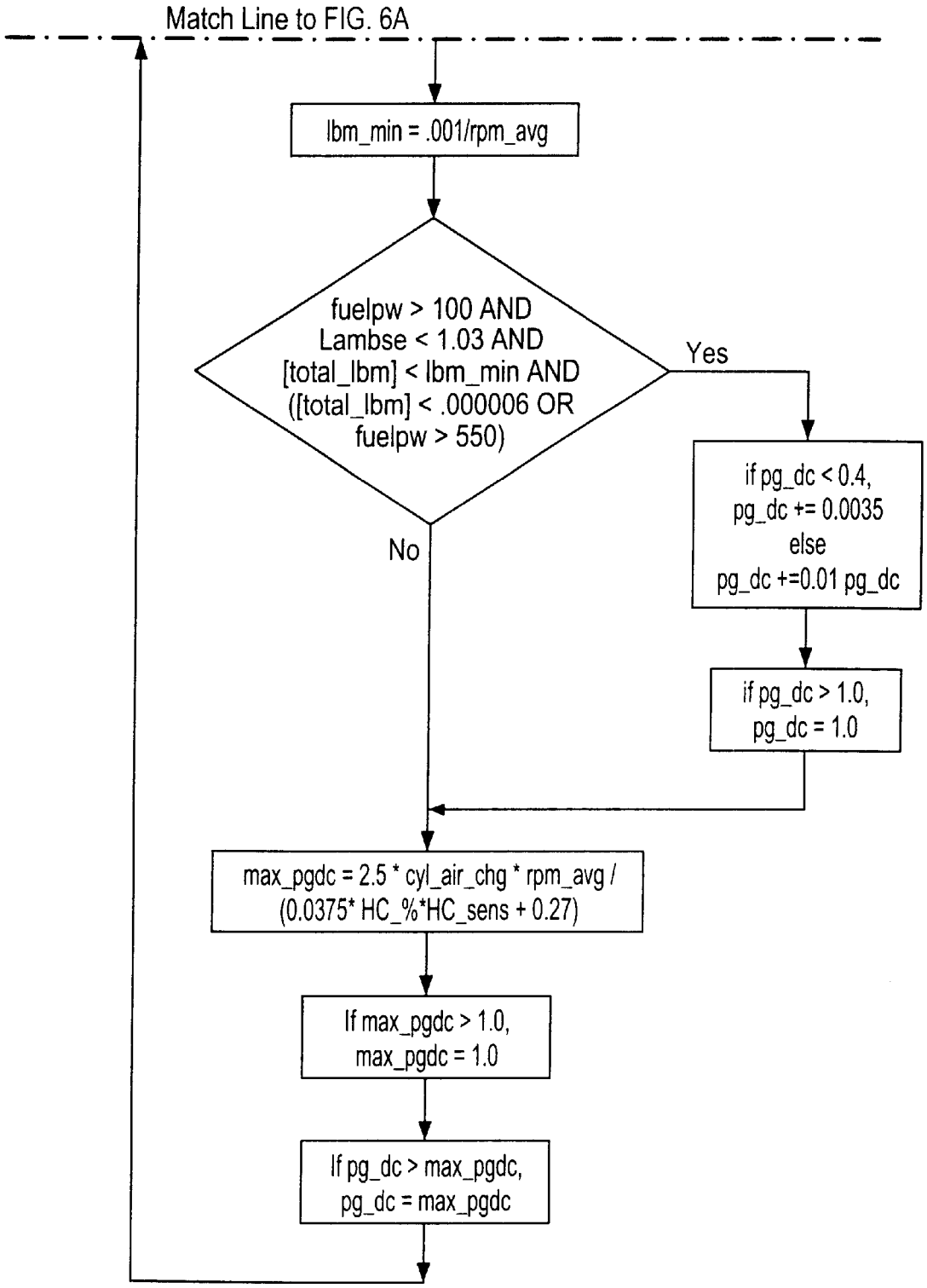

A flow diagram of the program used by the vapor management control valve module 95 (FIG. 1) is shown in FIG. 6. The effect of this module is to ramp open the purge valve at different rates when conditions are appropriate, to shut it off under other conditions, and to limit its opening when sufficient hydrocarbon concentration is present so that the fuel pulse width does not get so small that accuracy or ability to handle transients is adversely affected.

Excerpts from the C code used for the routines in the pg_dc module 602 (FIG. 7), the segment calculation and transport delay module 604 (FIG. 8) and the pgdc_lbm module 610 follow (it being understood that the gains, offset and limits, etc. were for a particular valve):

The following code is performed in the transport delay, $\tau_d$, module 60 (FIG. 3):

```
/******** pgdc_flow and total_lbm calculations: *******/
    /* simple linear fit from pg_dc to lambse offset: */
    pgdc_flow = 130.825 * pg_dc − 35.071 ;              /* 1 per min.*/
    if (pg_dc < .27) pgdc_flow = 0.0 ;
    /* delay from rational fn. fit to observed data:   */
    tdelay = 0.06 + 76.72 / (pgdc_flow + 3.8) ;         /* seconds      */
    if (tdelay < 0.3) tdelay = 0.3 ;
    tmp_rpm = engine_rpm ;
    if (tmp_rpm < 450.) tmp_rpm = 450.;
    tint = 60.0 * fcount / (no_cyls * tmp_rpm) ;        /* interval     */
    if (tint < 0.01) tint = 0.01 ;                      /* since last */
    segments += tube_vol / seg_vol * tint / tdelay ;
    nseg = (int) segments ;
    segments −= nseg ;                                  /* carry over for next time */
    frac = segments ;
```

The code for the transport module 812 (and 608), and the ff_lbm calculation module 610 (FIG. 9), is as follows:

```
hc_delayed=peristal2 (Y[2],frac,nseg, tot_segs, 0);
    /* lb. per min */
pgdc_ppm=0.003171806*hc_delayed*seg_vol/tint;
last_ff_lbm=ff_lbm;
pgdcfppm=0.8*pgdcfppm+0.2*pgdc_ppm;/*0.2s filter */
pgdc_lbm=pgdcfppm/(3.0*tmp_rpm);/* lb. per inj. */
```

The multiplier 99 is fed HC_sens from the adaptive HC sensitivity compensation module 103 (FIG. 1) along with the ff_lbm signal produced by the transport delay module 60 (FIG. 1) as follows:

ff_lbm=HC_sens*pgdc_lbm

The output of the multiplier 99 (pgdc_lbm) is algebraically summed with fb_lbm from the feedback loop module 92 in summer 101 (FIG. 1) to produce total_lbm, as follows:

total_lbm=fb_lbm+ff_lbm

The code performed by the transport module 812 (FIG. 8) follows:

```
float peristal2 (input, fraction, numb, max_delay, init_flag)
double input, fraction
int numb, max_delay, init_flag
{
        /* models a variable time delay system:                          */
        /* input feeds the delay line of max_delay segments. Each time   */
        /* called, num no. of segments are accumulated as output.        */
        /* A fraction of the next segment is also accumulated, and its   */
        /* value is decremented for the next time.                       */
    int j, k ;
static int first_time = 1 ;
static float * tdl_in ;
static float frac, s_out ;
        /* Initialization: */
    if (first_time) {
        tdl_in = (float *) calloc ( (int) (max_delay+1),sizeof(float)) ;
        for (j=0; j <= max_delay ; j++)   {
            tdl_in[j] = 0.0 ;
        }
        s_out = 0.0 ;
        first_time = 0 ;
    }
if (init_flag) {
    for (j=0; j <= max_delay ; j++)   {
        tdl_in[j] = input ;
    }
}
    /* Input delay line */
s_out = 0.0 ;
if (numb >= 1) {
    for (k=1; k <= numb ; k++)   {          /* cycle numb times:          */
        s_out += tdl_in[0] ;                /* accum. what's output       */
        for (j=1; j <= max_delay ; j++)  { /* cycle the delay line       */
            tdl_in[j-1] = tdl_in[j] ;
        }
        tdl_in[max_delay] = input ;         /* feed input                 */
    }
}
    frac = fraction * tdl_int[0] ;          /* add in a fraction more     */
    s_out += frac ;                         /* remove what was taken      */
    tdl_in[0] -= frac ;                     /* return accum. output       */
    return (s_out);
}
```

The following code is performed by the adaptive hydrocarbon sensitivity module 103 (FIG. 5):

```
        /* adapt HC_sens: adjust HC_sens every 50 background loops */
if (updcount= =50) {
    if (avgfcomp>.0000005)   {
        HC_sens += .05;
    } else if (avgfcomp<-.0000005) {
        HC_sens -= .05;
    }
    updcount = 0;
} else {
    updcount += 1;
}
if (HC_sens>3.) {
    HC_sens = 3.;
} else if (HC_sens<.5) {
    HC_sens = .5;
}
```

The sum of the feed back and adapted feed forward terms, total_lbm, estimating the total effect of the purge hydrocarbons in pounds of (equivalent) fuel per injection is processed by conventional calculations to produce the fuel injector 26 composite control signal on line 30. The combination of internal model feedback control, fb_lbm, with feed forward compensation, ff_lbm, based on a HC sensor 35 signal on line 34 results in reduced A/F disturbance for a given pattern of canister purge, compared to the prior method of integral feedback. Alternatively, more aggressive purging may be programmed and still maintain A/F deviations within acceptable limits. Transient conditions are handled by this approach with much less deviation of the control variables.

Figure 11:
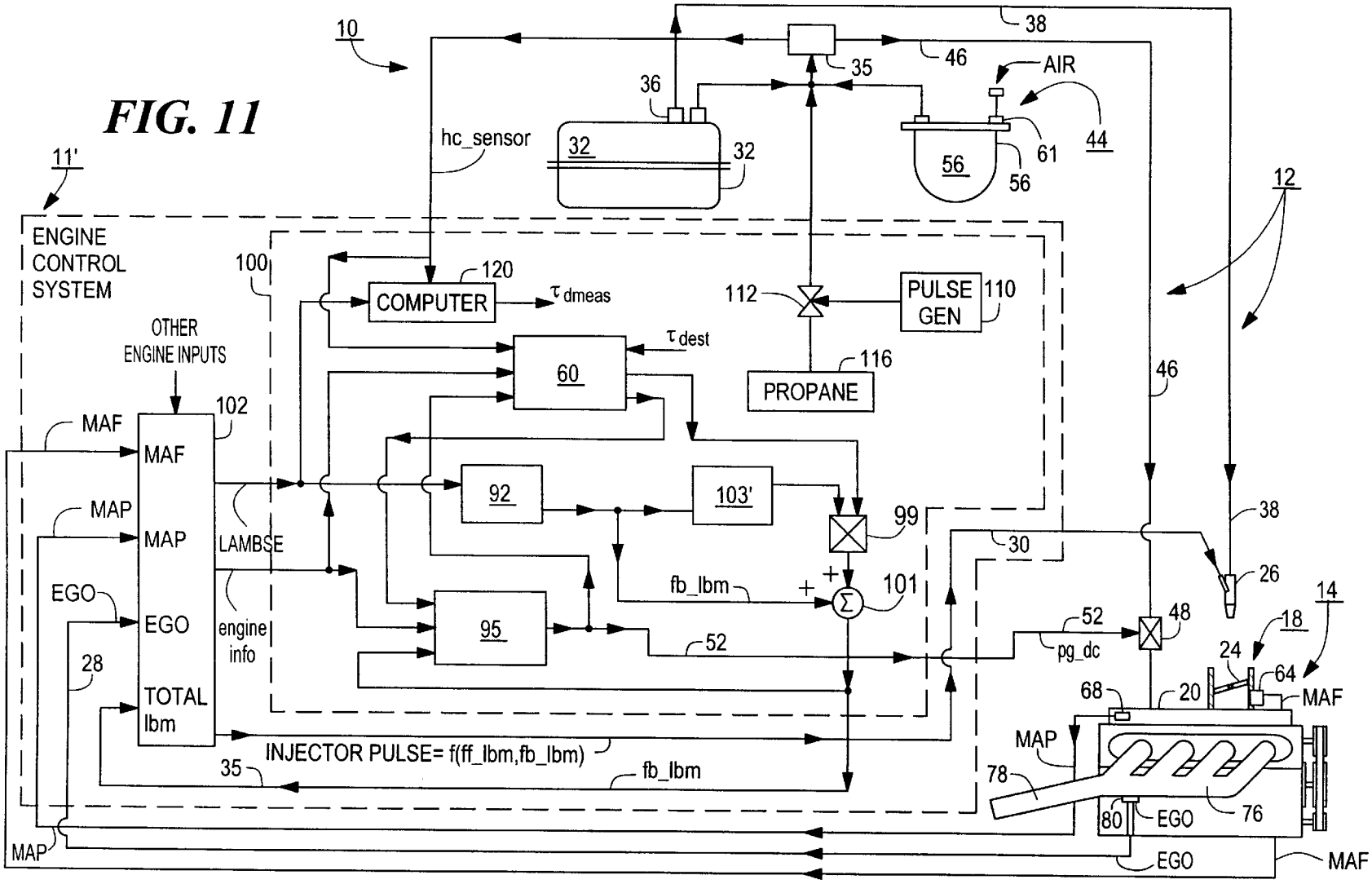
FIG. 11 is a block diagram of a test arrangement used to determine fuel transport delay in a vapor recovery system used for the engine of FIG. 1.

Referring now to FIG. 11, a test arrangement is described for determining the transport delay, $\tau_d$. It is first noted that the transport delay, $\tau_d$, is a function of the flow rate through the valve 48. Further, the flow rate through the valve 48 is a function of the duty cycle of the signal on line 52 (FIG. 1), i.e., pgdc_flow. Here, from the program above, in this example, pgdc_flow=130.825*pg_dc−35.071 and if pg_dc<2.68, then pgdc_flow is 0.0.

To measure $\tau_d$ as a function of pgdc_flow, with the engine 14 operating with the feedback signal fb_lbm produced by the engine control system 11', an estimate is made of the delay, i.e., $\tau_{dest}$ for module 60. With the valve 48 operating at a particular pgdc_flow selected by module 95 and with the HC sensitivity comp 103 (FIG. 1) here represented as 103' providing a suitable constant for the particular gas being sensed, here propane, a pulse generator 110 sends a pulse to open a valve 112. Fed to the valve 112 is a high concentration of a hydrocarbon (HC), here propane for example, from a propane source 116. The step change in propane is fed to the fuel line upstream of the hydrocarbon sensor 35. In response to the step change in propane, both the output of the hydrocarbon sensor 35 and the EGO sensor 80 output signal on line 28 will change significantly, albeit with a time delay between them, such time delay being the transport delay, $\tau_{dactual}$. The LAMBSE error will correspondingly experience a step change. The output of the hydrocarbon sensor 35 and the LAMBSE error signal produced by the module 102 are fed to a computer 120. It is noted that during the testing process, the difference between $\tau_{dest}$ and $\tau_{dactual}$ (i.e., the time delay measured by the computer 120) is used to adjust the estimated delay $\tau_{dest}$ and the process is repeated until $\tau_{dest}$ is equal to $\tau_{dactual}$. Thus, for each selected pgdc_flow, the transport delay time, $\tau_d$, is measured between the time the hydrocarbon sensor 35 detects the pulse of propane and the time there is a step in LAMBSE error (i.e., the time there is a step change in the output of the EGO sensor 80).

Having determined the relationship between the transport delay time, $\tau_d$, and flow rate through the valve 48 (i.e., pgdc_flow), a lookup table or functional fit equation may be used to store such relationship in the transport model 608 (FIG, 3). Here, as noted from the program above, in this example, tdelay, (i.e., the transport delay time, $\tau_d$,)=0.06+76.72/(pgdc_flow+3.8) with a minimum of tdelay of 0.3.

It is noted that preferably the valve 48 is placed close to the intake manifold 20 in order to shut the flow in the event that a relatively large amount of fuel is being purged.

A number of embodiments of the invention have been described. Nevertheless, it will be understood that various modifications may be made without departing from the spirit and scope of the invention. Accordingly, other embodiments are within the scope of the following claims.

What is claimed is:

1. A method for controlling an air/fuel ratio of an engine, such engine being supplied fuel from a fuel injection system to inject fuel into a cylinder of such engine, such method, comprising:

providing a model of the engine, such model representing a relationship between: (1) a signal model representative of estimated air/fuel ratio of the engine relative to a stoichiometric air/fuel ratio for the engine; and, (2) fuel injected into the cylinder of the engine;

measuring exhaust gas oxygen emission from the engine during operation of such engine;

producing as a function of such measured oxygen, an actual signal representative of the actual air/fuel ratio of the engine relative to a stoichiometric air/fuel ratio for the engine produced by such engine during operation of such engine;

comparing the actual signal with the signal model provided by the model in response to fuel injected into the engine to produce a model error signal;

adjusting the fuel injected into the engine in accordance with the model error signal.

2. The method recited in claim 1 wherein the adjusting comprises:

providing a reference signal representative of a reference air/fuel ratio of the engine relative to a stoichiometric air/fuel ratio for the engine;

providing a model inverse to the first-mentioned model;

comparing the error signal with the reference signal to produce a second error signal;

feeding the second error signal to the inverse model to generate a fuel signal for injecting fuel into the engine, such fuel signal being fed to the first-mentioned model to provide the signal model.

3. The method recited in claim 2 wherein the first-mentioned model includes a first section representative of a delay-free model of the engine and a second section representative of a delay in the engine between a time a change in the fuel is injected into the engine and a time a change in the oxygen in the exhaust emission from such change in fuel is measured and wherein the method combines the delay free model output signal with the second error signal to produce the signal fed to the inverse model.

4. The method recited in claim 3 wherein the method combines an output of the second section with the actual signal to produce the first-mentioned error signal.

5. The method recited in claim 4 wherein the first-mentioned model is a linear model.

6. The method recited in claim 5 wherein the delay free section is represented as:

$$y_m=1+G_m u,$$

where $G_m$ is the gain of the linear model, u is the input to the linear model and $y_m$ is the output of the linear model.

7. The method recited in claim 6 wherein the reference signal includes a feedforward air/fuel ratio control signal in accordance with anticipated fuel through a purging system.

8. The method recited in claim 7 wherein the producing the feedforward air/fuel ratio control signal comprises determining fuel flow rate through the purge system.

9. The method recited in claim 8 wherein the purge system includes a valve, such valve passing the fuel in the purging system to the intake manifold at a rate related to a duty cycle of a control signal fed to such valve and wherein the flow rate through the purge system is determined in response to the duty cycle the control signal fed to the valve.

* * * * *